US012623836B2

(12) United States Patent
Springer

(10) Patent No.: US 12,623,836 B2
(45) Date of Patent: May 12, 2026

(54) DISPENSING PORT ADAPTER DEVICE AND METHOD

(71) Applicant: Joseph Springer, Vevay, IN (US)

(72) Inventor: Joseph Springer, Vevay, IN (US)

( * ) Notice: Subject to any disclaimer, the term of this patent is extended or adjusted under 35 U.S.C. 154(b) by 499 days.

(21) Appl. No.: 18/122,297

(22) Filed: Mar. 16, 2023

(65) Prior Publication Data

US 2024/0308756 A1 Sep. 19, 2024

(51) Int. Cl.
*B65D 88/54* (2006.01)
*B65D 83/04* (2006.01)

(52) U.S. Cl.
CPC ..... *B65D 88/54* (2013.01); *B65D 83/04* (2013.01); *B65D 2588/545* (2013.01)

(58) Field of Classification Search
CPC ..... F16L 21/065; F16L 21/002; F16L 21/022; F16L 21/08; B65D 88/54; B65D 83/04; B65D 2588/545
USPC ..... 285/139.2, 139.3, 404, 4, 142.1
See application file for complete search history.

(56) References Cited

U.S. PATENT DOCUMENTS 1,292,524 A * 1/1919 Serrell ..... F16L 33/30 285/8
1,684,582 A * 9/1928 Hoaglund ..... E21B 33/03 277/621
1,933,117 A * 10/1933 Markle ..... F16L 55/10 411/429
1,982,879 A * 12/1934 Overbury ..... B65D 88/54 220/86.2
2,576,192 A * 11/1951 Poznik ..... B60K 15/04 137/526
3,405,958 A * 10/1968 Holdren ..... B08B 9/093 285/192
3,478,922 A * 11/1969 Mole ..... B60K 15/04 220/229
3,654,965 A * 4/1972 Gramain ..... F16L 55/115 52/100
D243,655 S 3/1977 Matousek
4,158,276 A * 6/1979 Stoneman ..... E04D 13/1407 52/219
4,746,023 A * 5/1988 Belter ..... F16L 5/10 277/924
4,846,506 A * 7/1989 Bocson ..... F16L 37/0987 285/27
4,902,043 A * 2/1990 Zillig ..... F16L 37/0987 285/379

(Continued)

FOREIGN PATENT DOCUMENTS

WO WO2007049980 3/2007

*Primary Examiner* — David Bochna

(57) ABSTRACT

A dispensing port adapter device for preventing a loss of pellets from a feed tube to a suction tube includes a sleeve extending from a first end to a second end. A chamber space is defined within the sleeve and the second end receives the feed tube of the railway car hopper into the chamber space of the sleeve. An end wall is attached to the sleeve and covers the first end. The end wall has an aperture extending therethrough to receive the suction tube. A securing member is mounted on the sleeve and secures the sleeve to the feed tube wherein an outlet of the feed tube is positioned within the chamber space. A seal is attached to the end wall and covers the aperture to prevent the pellets from exiting the sleeve through the aperture.

1 Claim, 7 Drawing Sheets

(56) References Cited

U.S. PATENT DOCUMENTS

| | | | | | |
|---|---|---|---|---|---|
| 5,078,429 | A | * | 1/1992 | Braut | F16L 37/098 285/4 |
| 5,106,127 | A | * | 4/1992 | Briet | F16L 37/38 285/110 |
| 5,954,345 | A | * | 9/1999 | Svoboda | F16H 57/029 277/606 |
| D593,641 | S | | 6/2009 | Plank | |
| 8,608,206 | B2 | | 12/2013 | Fedale, Sr. | |
| D699,328 | S | | 2/2014 | Haynes | |
| 9,255,412 | B2 | | 2/2016 | Haynes | |

* cited by examiner

DISPENSING PORT ADAPTER DEVICE AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to spout fitting devices and more particularly pertains to a new spout fitting device for preventing a loss of plastic pellets from a feed tube to a suction tube when the plastic pellets are being removed from a hopper and more particularly from a railcar being used as a transportation hopper for the plastic pellets.

(2) Description of Related Art Including Information Disclosed Under 37 CFR 1.97 and 1.98

The prior art relates to adapter devices and includes a variety of adapter devices coupling an end of a first piping to an end of a second piping having unequal diameters. Known prior art does not include an adapter device enclosing the ends of the first piping and the second piping within an enclosed space.

BRIEF SUMMARY OF THE INVENTION

An embodiment of the disclosure meets the needs presented above by generally comprising a sleeve being elongated from a first end to a second end. The first end and the second end are open. A chamber space is defined within the sleeve. The second end is configured to removably receive the feed tube of the railway car hopper into the chamber space of the sleeve. An end wall is attached to the sleeve and covers the first end. The end wall has an aperture extending therethrough configured to receive the suction tube. A securing member is mounted on the sleeve and is configured to releasably secure the sleeve to the feed tube wherein an outlet of the feed tube is positioned within the chamber space. A seal is attached to the end wall and covers the aperture to restrict the pellets from exiting the sleeve through the aperture.

Another embodiment of the disclosure comprises a method including the steps of mounting a sleeve on a feed tube in fluid communication with the railway car hopper such that a first end of the sleeve is positioned distal to the railway car hopper. The sleeve secures to the feed tube such that a free end of the feed tube is positioned within the sleeve. A suction tube extends through a seal closing the first end such that the seal forms a barrier around the suction tube to restrict pellets from flowing outwardly of the second end of the sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
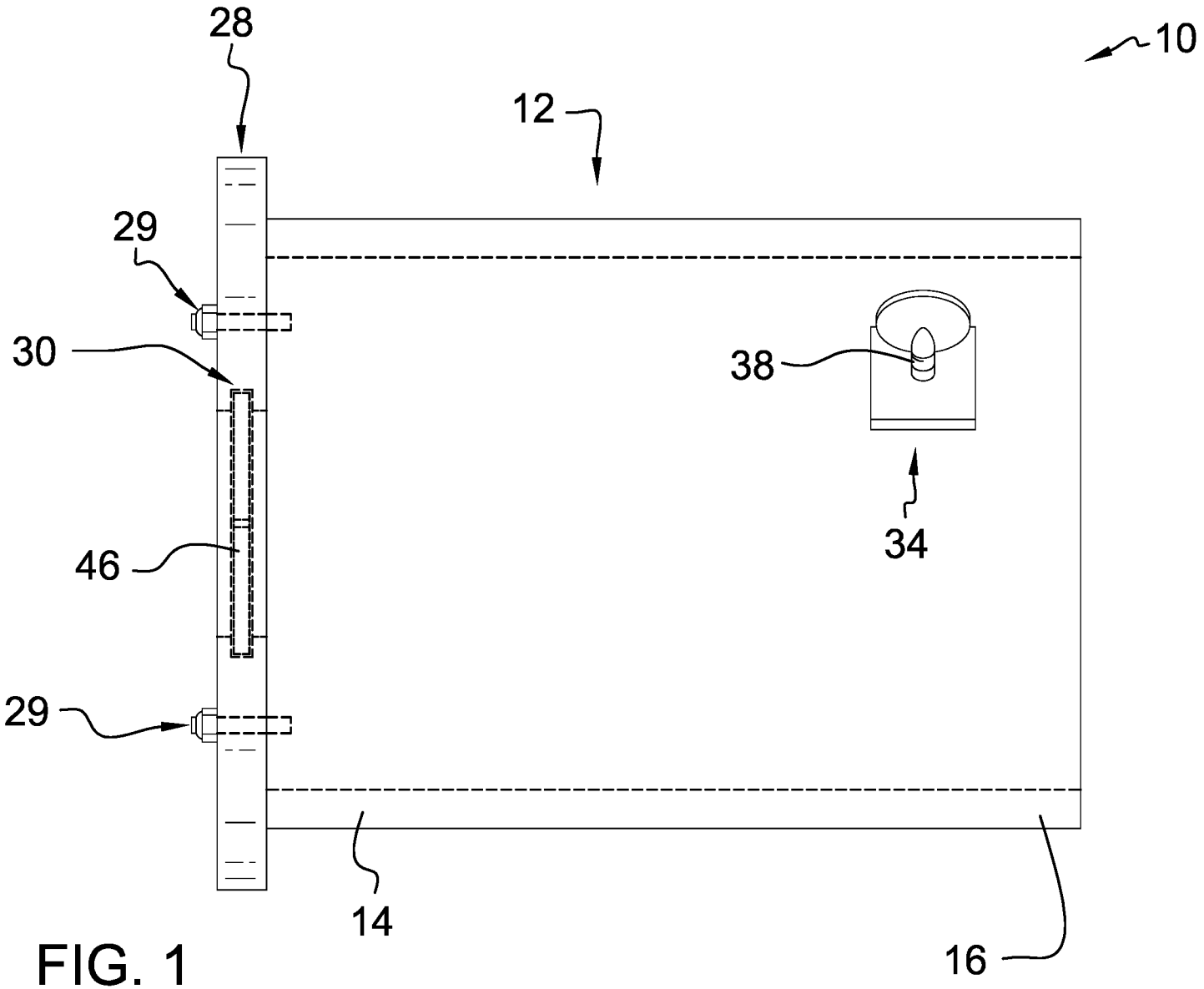
FIG. 1 is a front view of a dispensing port adapter device according to an embodiment of the disclosure.
Figure 2:
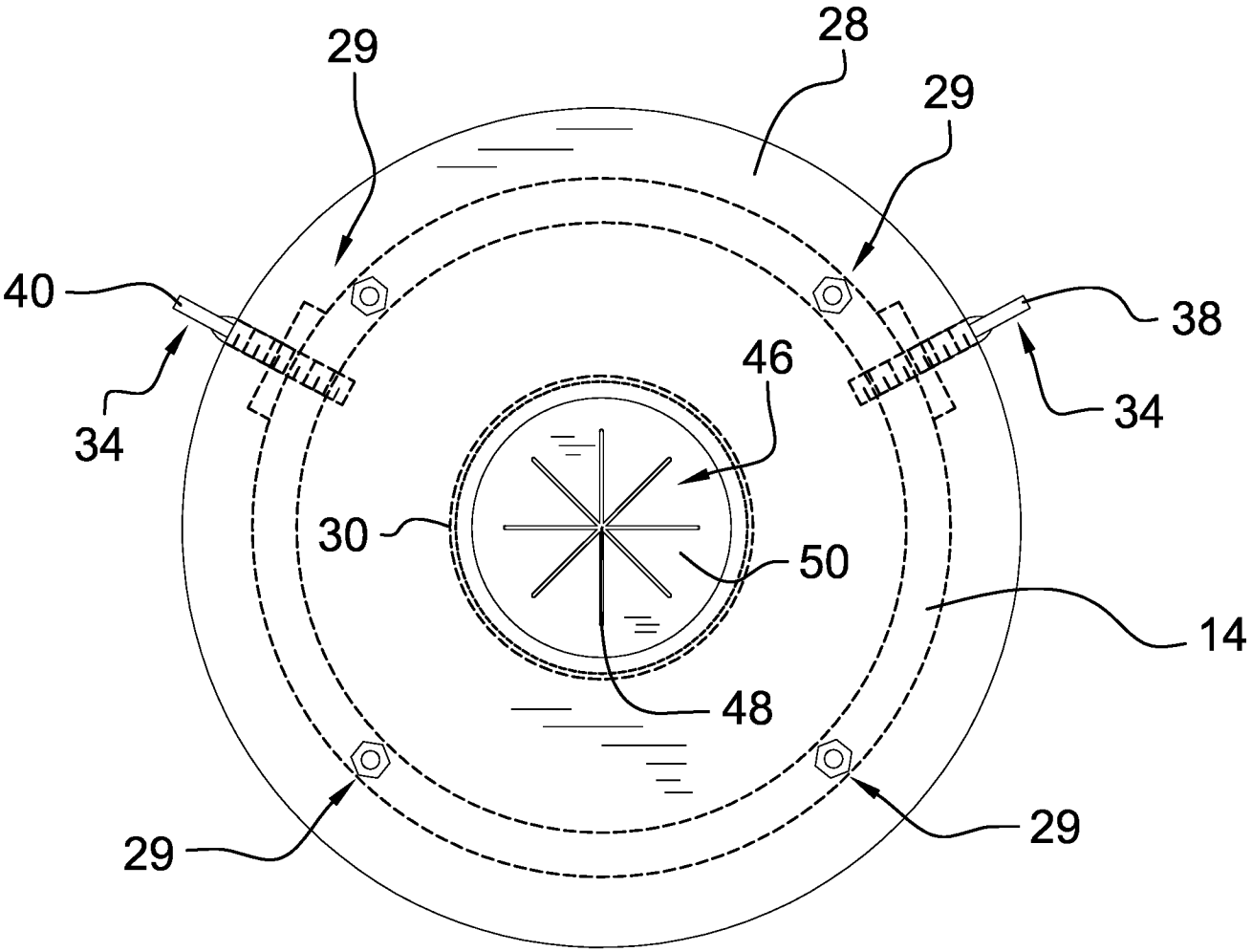
FIG. 2 is a left-side view of an embodiment of the disclosure.
Figure 3:
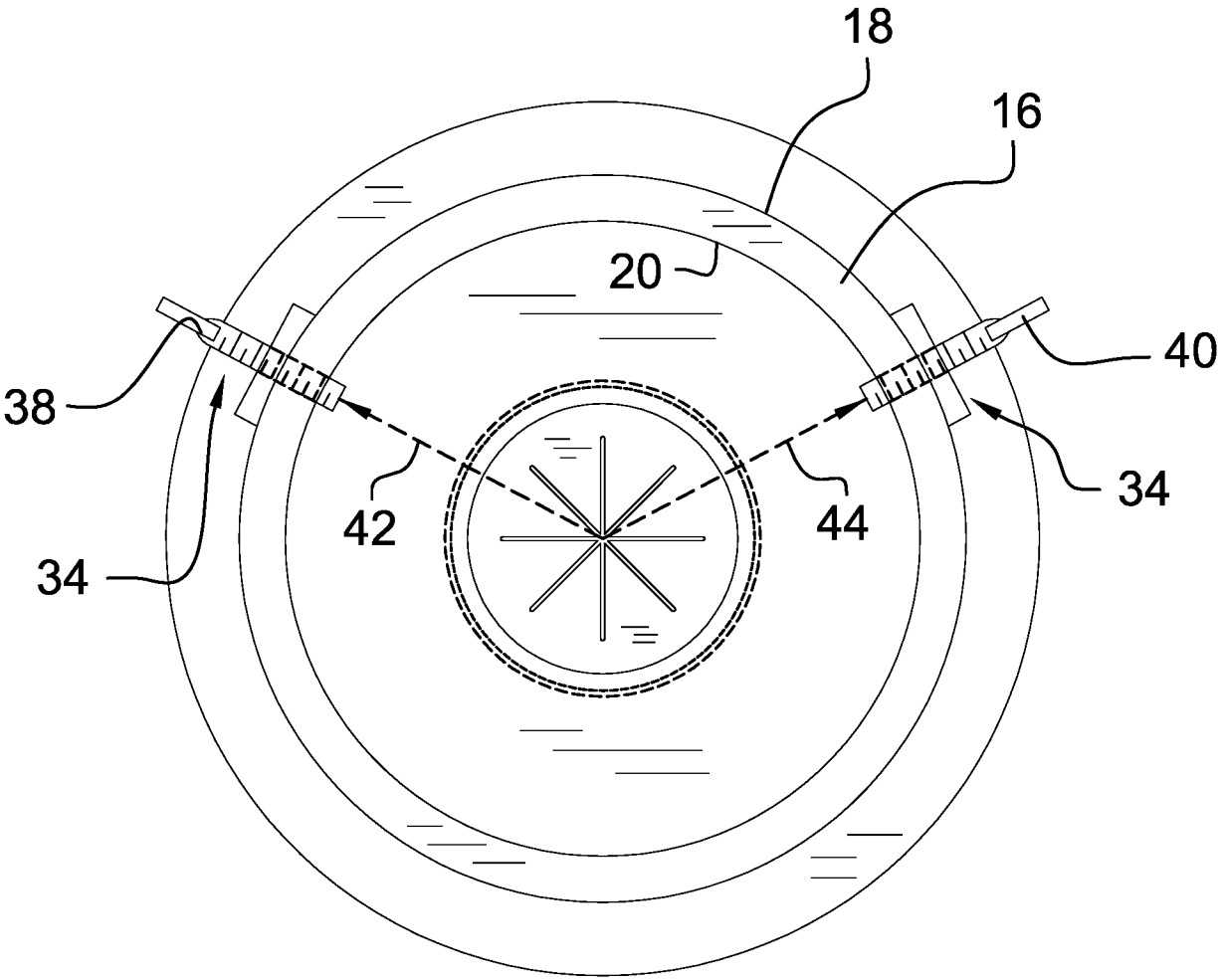
FIG. 3 is a right-side view of an embodiment of the disclosure.
Figure 4:
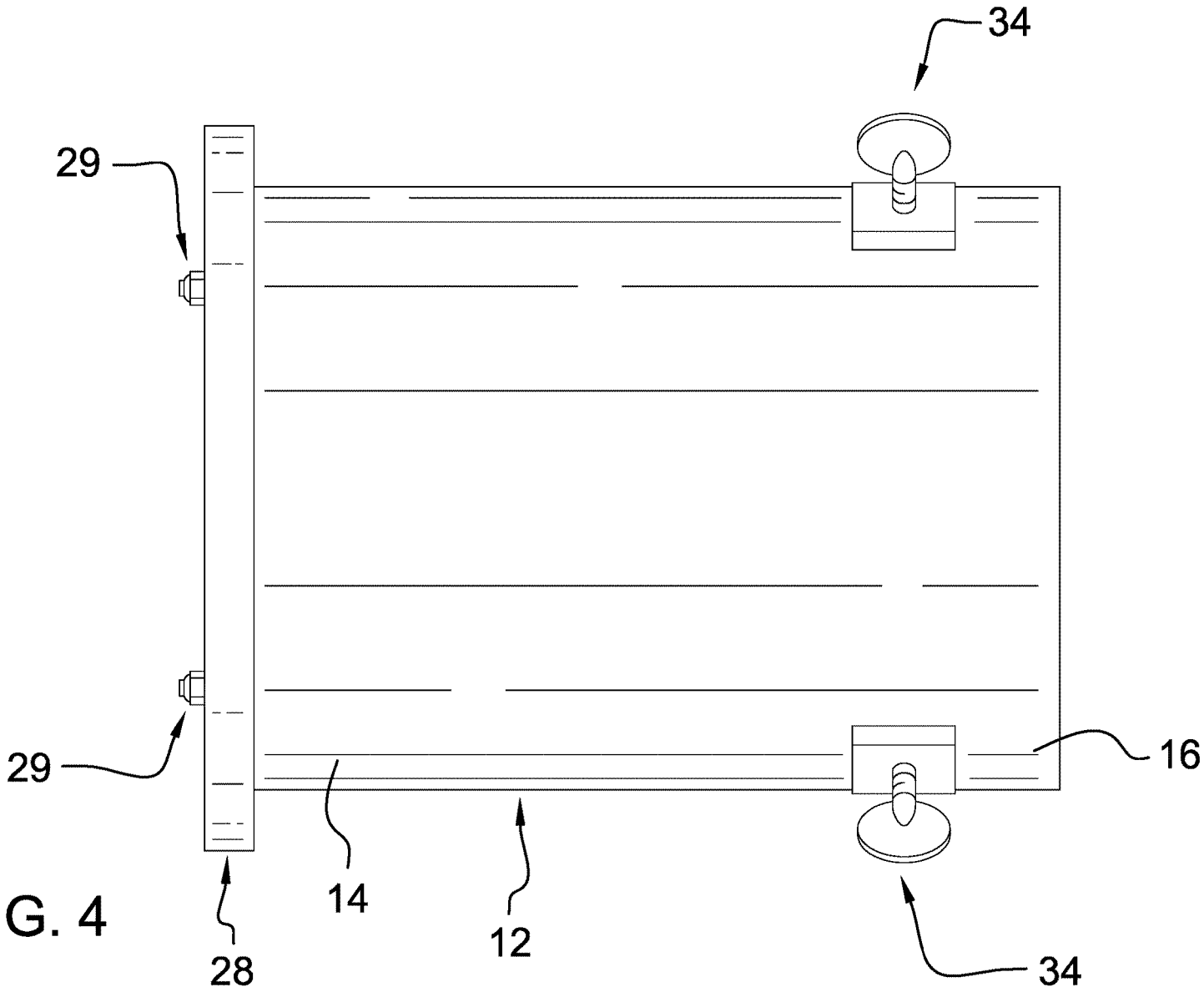
FIG. 4 is a top view of an embodiment of the disclosure.
Figure 5:
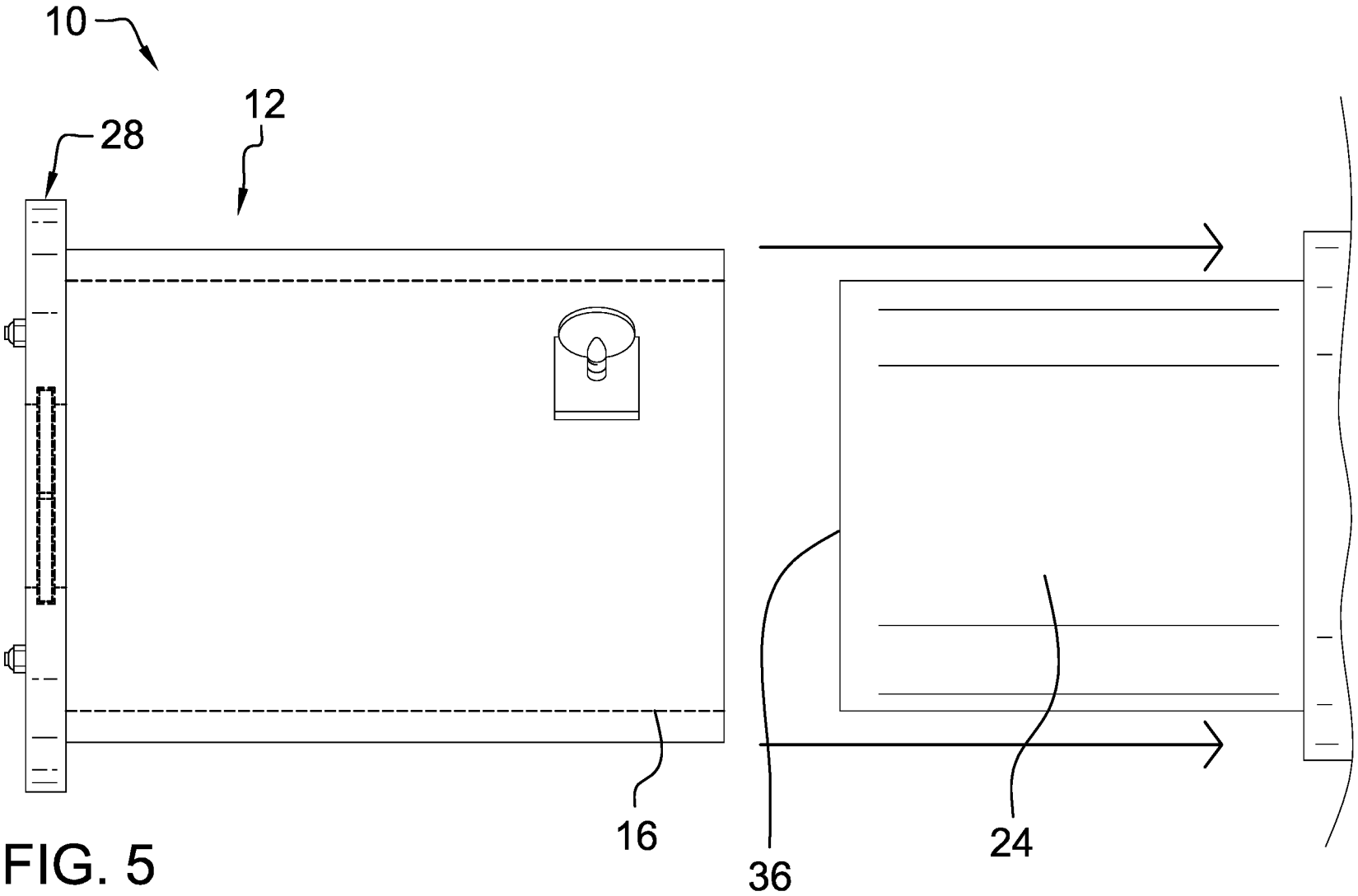
FIG. 5 is an in-use view of an embodiment of the disclosure.
Figure 6:
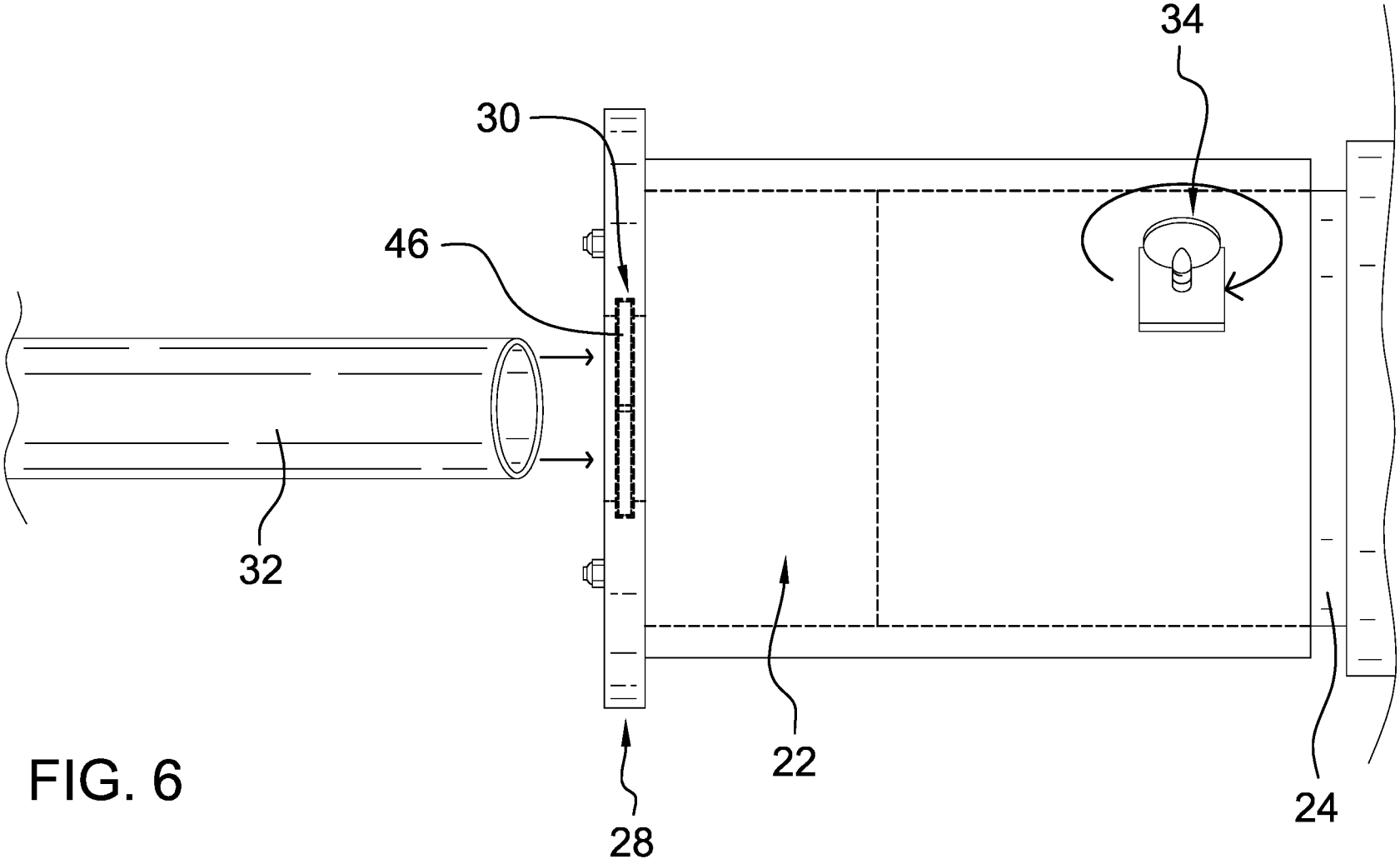
FIG. 6 is an in-use view of an embodiment of the disclosure.
Figure 7:
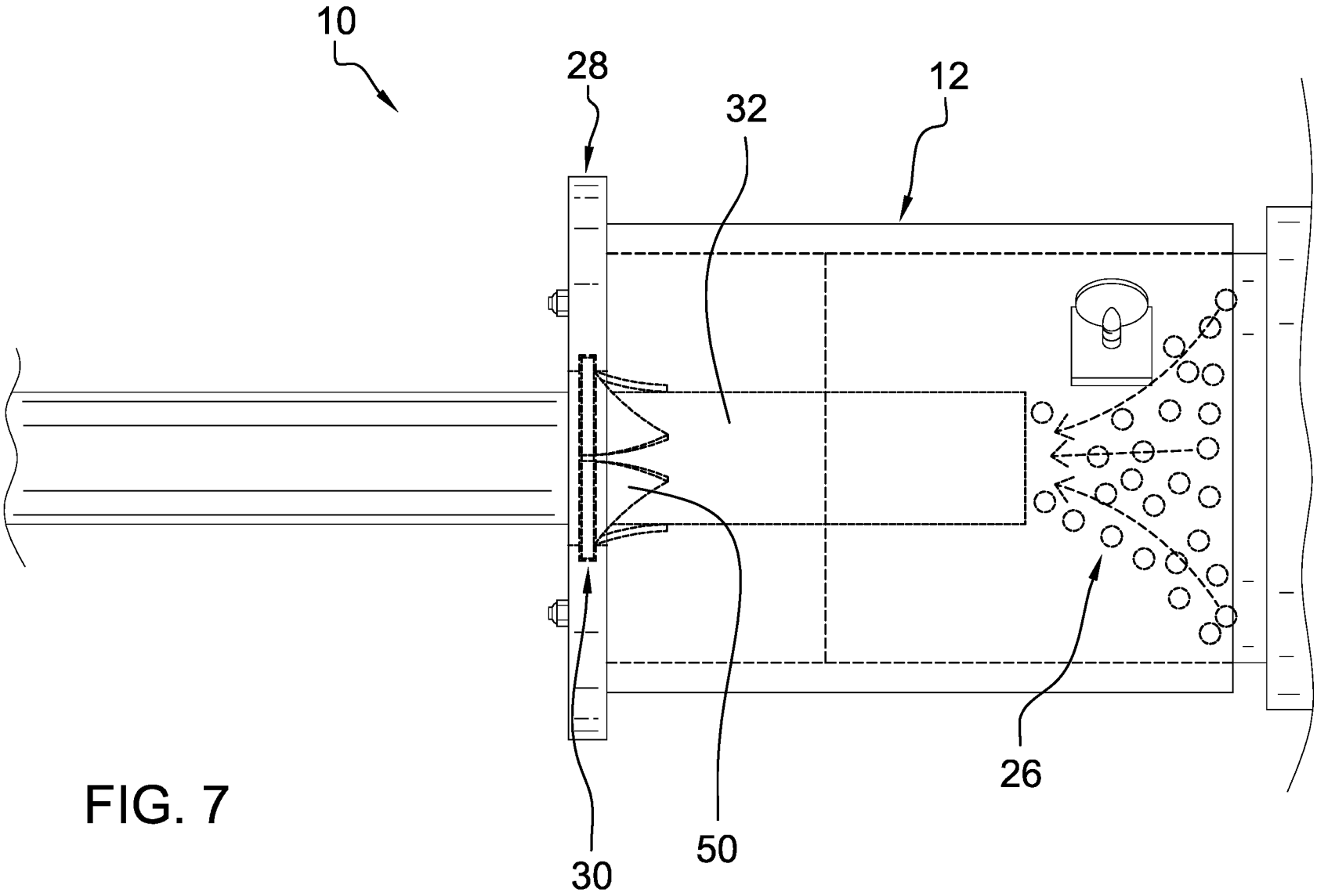
FIG. 7 is an in-use view of an embodiment of the disclosure.

With reference now to the drawings, and in particular to FIGS. 1 through 7 thereof, a new adapter device embodying the principles and concepts of an embodiment of the disclosure and generally designated by the reference numeral 10 will be described.

As best illustrated in FIGS. 1 through 7, the dispensing port adapter device 10 generally comprises a sleeve 12 being elongated from a first end 14 to a second end 16. The first end 14 and the second end 16 are open and the sleeve 12 includes an exterior surface 18 and an interior surface 20. A chamber space 22 is defined within the sleeve 12 and the second end 16 is configured to removably receive a feed tube 24 of a railway car hopper into the chamber space 22 of the sleeve 12. The feed tube 24 of the railway car hopper dispenses pellets 26 typically used for injection molding, wherein the pellets 26 comprise a plastic material being heated into a liquid state within a mold to form a product as the pellets 26 are cooled into a solid state. The sleeve 12 normally has a cylindrical shape corresponding to a conventional feed tube 24 of the railway car hopper, wherein the interior surface 20 of the sleeve 12 may abut against the feed tube 24 positioned within the chamber space 22. An end wall 28 is attached to the sleeve 12 and covers the first end 14. The end wall 28 may include a fastening member 29 to secure the end wall 28 to the first end 14 of the sleeve 12. The fastening member 29 may comprise a plurality of threaded bolts being threadably coupled to and extending through the end wall 28 into the first end 14 of the sleeve 12. The end wall 28 has an aperture 30 extending therethrough configured to receive a suction tube 32.

A securing member 34 is mounted on the sleeve 12 and is configured to releasably secure the sleeve 12 to the feed tube 24 wherein an outlet 36 of the feed tube 24 is positioned within the chamber space 22. The securing member 34 normally comprises one or more threaded fasteners being threadably coupled to and extending through the sleeve 12, wherein the one or more fasteners is each abuttable against the feed tube 24 to frictionally restrict movement of the sleeve 12 relative to the feed tube 24. The one or more threaded fasteners typically includes at least a first threaded fastener 38 and a second threaded fastener 40. Each of the first 38 and second 40 threaded fasteners is correspondingly axially aligned with a first radius 42 and a second radius 44 of the sleeve 12. The first 42 and second 44 radii lie in a same plane with respect to each other.

A seal 46 is attached to the end wall 28 and covers the aperture 30 to restrict the pellets 26 from exiting the sleeve 12 through the aperture 30. The seal 46 has an opening 48 therein configured to receive the suction tube 32, wherein the seal 46 is configured to removably receive the suction tube 32 into the chamber space 22. The seal 46 includes a plurality of resiliently bendable flaps 50 for conforming to the shape of the suction tube 32. The resiliently bendable flaps 50 may comprise a silicone rubber material or any other conventionally bendable material. The seal 46 and the end wall 28 may also be a unitary structure, wherein the seal 46 forms the end wall 28 and has a central opening therein which is covered by the resiliently bendable flaps 50.

In use, the sleeve 12 is mounted on the feed tube 24 and in fluid communication with the railway car hopper such that the first end 14 of the sleeve 12 is positioned distal to the railway car hopper. The sleeve 12 secures to the feed tube 24 such that a free end of the feed tube 24 is positioned within the sleeve 12. The suction tube 32 extends through the seal 46 closing the first end 14 such that the seal 46 forms a barrier around the suction tube 32 to restrict pellets 26 from flowing outwardly of the second end 16 of the sleeve 12. The railway car hopper is actuated to dispense the pellets 26 from the feed tube 24 and the suction tube 32 collects the pellets 26 by suctioning the pellets 26 from the feed tube 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dispensing port adapter device configured to prevent a loss of pellets when transferring the pellets from a feed tube of a railway car hopper to an inlet of a suction tube, said dispensing port adapter device comprising:

a sleeve being elongated from a first end to a second end, said first end and said second end being open, said sleeve including an exterior surface and an interior surface, a chamber space being defined within said sleeve, said second end being configured to removably receive the feed tube of the railway car hopper into said chamber space of said sleeve, said sleeve having a cylindrical shape;

an end wall being attached to said sleeve and covering said first end, said end wall having an aperture extending therethrough configured to receive the suction tube;

a securing member being mounted on said sleeve and being configured to releasably secure the sleeve to the feed tube wherein an outlet of the feed tube is positioned within said chamber space, said securing member comprising one or more threaded fasteners being threadably coupled to and extending through said sleeve, wherein said one or more fasteners is each abuttable against the feed tube to frictionally restrict movement of the sleeve relative to the feed tube, said one or more threaded fasteners including at least a first threaded fastener and a second threaded fastener, each of said first and second threaded fasteners being correspondingly axially aligned with a first radius and a second radius of said sleeve, said first and second radii lying in a same plane with respect to each other;

a seal being attached to said end wall and covering said aperture to restrict the pellets from exiting said sleeve through said aperture, said seal having an opening therein configured to receive the suction tube, wherein said seal is configured to removably receive the suction tube into said chamber space, said seal including a plurality of resiliently bendable flaps for conforming to the shape of the suction tube.

* * * * *